US010029128B2

(12) United States Patent
Lin

(10) Patent No.: US 10,029,128 B2
(45) Date of Patent: Jul. 24, 2018

(54) AUTO-ARRESTING SAFETY DEVICE

(71) Applicant: GENERAL SAFETY COMPANY LTD., Taichung (TW)

(72) Inventor: Mao-Tsun Lin, Taichung (TW)

(73) Assignee: GENERAL SAFETY COMPANY LTD., Taichung (TW)

( * ) Notice: Subject to any disclaimer, the term of this patent is extended or adjusted under 35 U.S.C. 154(b) by 0 days.

(21) Appl. No.: 15/357,186

(22) Filed: Nov. 21, 2016

(65) Prior Publication Data

US 2018/0078795 A1 Mar. 22, 2018

(30) Foreign Application Priority Data

Sep. 21, 2016 (TW) ..... 105214471 U

(51) Int. Cl.
*B66F 11/00* (2006.01)
*A62B 1/10* (2006.01)

(52) U.S. Cl.
CPC ..... *A62B 1/10* (2013.01)

(58) Field of Classification Search
CPC .. A62B 1/06; A62B 1/10; A62B 35/04; B66C 1/64
USPC ..... 188/65.1–65.5, 180, 181 T, 184, 186; 182/73, 231, 232, 237, 239
See application file for complete search history.

(56) References Cited

U.S. PATENT DOCUMENTS 5,186,289 A * 2/1993 Wolner ..... A62B 1/12 182/232
5,447,280 A * 9/1995 Feathers ..... A62B 1/10 182/237
2010/0226748 A1* 9/2010 Wolner ..... A62B 35/0093 414/815
2011/0147125 A1* 6/2011 Blomberg ..... H02K 49/043 182/232
2011/0220436 A1* 9/2011 Green ..... A62B 35/0093 182/232
2011/0278095 A1* 11/2011 Hetrich ..... A62B 1/10 182/231
2011/0315483 A1* 12/2011 Griffiths ..... A62B 1/10 182/232
2012/0118670 A1* 5/2012 Olson ..... A62B 1/10 182/232

(Continued)

FOREIGN PATENT DOCUMENTS

TW M360706 7/2009

*Primary Examiner* — Christopher P Schwartz

(74) *Attorney, Agent, or Firm* — Muncy, Geissler, Olds & Lowe, P.C.

(57) ABSTRACT

An auto-arresting safety device includes a shell member, an axle connected to the shell member, a wire rope drum assembly attached to and rotatable on the axle, a fall arrest assembly coupled to and rotatable on the axle, and a brake assembly connected to the shell member and stopped at the fall arrest assembly. When the wire rope drum assembly receives a fall load over a threshold load, the wire rope drum assembly and the fall arrest assembly are joined together, and at the same time, the brake assembly brakes the rotation of the wire rope drum assembly and the fall arrest assembly intermittently until the wire rope drum assembly stops rotating. The auto-arresting safety device of the invention allows the wire rope drum assembly to rotate intermittently until fully stoppage, thereby effectively reducing and dispersing the instantaneously produced maximum fall load.

4 Claims, 9 Drawing Sheets

(56) References Cited

U.S. PATENT DOCUMENTS

2015/0352380 A1* 12/2015 Huang ..... A62B 1/10
188/65.3

* cited by examiner

AUTO-ARRESTING SAFETY DEVICE

BACKGROUND OF THE INVENTION

1. Field of the Invention

The present invention relates to safety devices and more particularly, to an auto-arresting safety device.

2. Description of the Related Art

Taiwan Patent Utility Number M360706 discloses an anti-fall safety device used to avoid a high-altitude or hanging worker from directly falling to the ground in case of stepping on the air or accidentally falling.

In the normal use, the anti-fall safety device is continuously letting off a safety line when the worker is moving. If the worker falls accidentally, a fall load over the set critical fall load of the anti-fall safety device will be produced, and the anti-fall safety device will be driven to stop letting off the safety line, i.e., the anti-fall safety device will be locked, suspending the falling worker in the air and avoiding the falling worker from directly falling to the ground.

Although the safety line has a wear-resistant design to prevent a safety line break, a certain part of the safety line can be rubbed against an object due to inertial swinging of the worker who is suspending in the air as the anti-fall safety device is locked and stopped from letting off the safety line. For instance, if a roof worker using the anti-fall safety device falls from the roof, the safety line will be forced to rub against the eaves as the roof worker is swinging in the air. In this case, the safety line can be cut off by the eaves, causing the worker to fall to the ground.

SUMMARY OF THE INVENTION

The present invention has been accomplished under the circumstances in view. It is the main object of the present invention to provide an auto-arresting safety device, which reduces and disperses the instantaneously produced maximum fall load and intermittently lets off the safety line when the user is falling, avoiding direct locking of the safety device and preventing the user from falling to the ground.

To achieve this and other objects of the present invention, an auto-arresting safety device comprises a shell member, an axle, a wire rope drum assembly, a fall arrest assembly and a brake assembly. The axle is connected to the shell member. The wire rope drum assembly is mounted on and rotatable relative to the axle. The fall arrest assembly is coupled to and rotatable on the axle. The brake assembly is connected to the shell member and for abutting against the fall arrest assembly. When the wire rope drum assembly receives a fall load over a threshold load, the wire rope drum assembly and the fall arrest assembly are joined together and at the same time, the brake assembly brakes the rotation of the wire rope drum assembly and the fall arrest assembly intermittently until the wire rope drum assembly stops rotating.

Thus, when the wire rope drum assembly receives a fall load over the threshold load, the brake assembly brakes the wire rope drum assembly and the fall arrest assembly intermittently to reduce and disperse the instantaneously produced maximum fall load, allowing the wire rope drum assembly to let off the safety line further so as to enhance the stability of structural safety.

Other advantages and features of the present invention will be fully understood by reference to the following specification in conjunction with the accompanying drawings, in which like reference signs denote like components of structure.

DETAILED DESCRIPTION OF THE INVENTION

The present invention will now be fully understood by reference to the following specification. However, it is to be understood that the sizes and appearances of the components illustrated in the accompanying drawings are simply for the purpose of illustration only, not intended to limit the scope of the invention.

Figure 1:
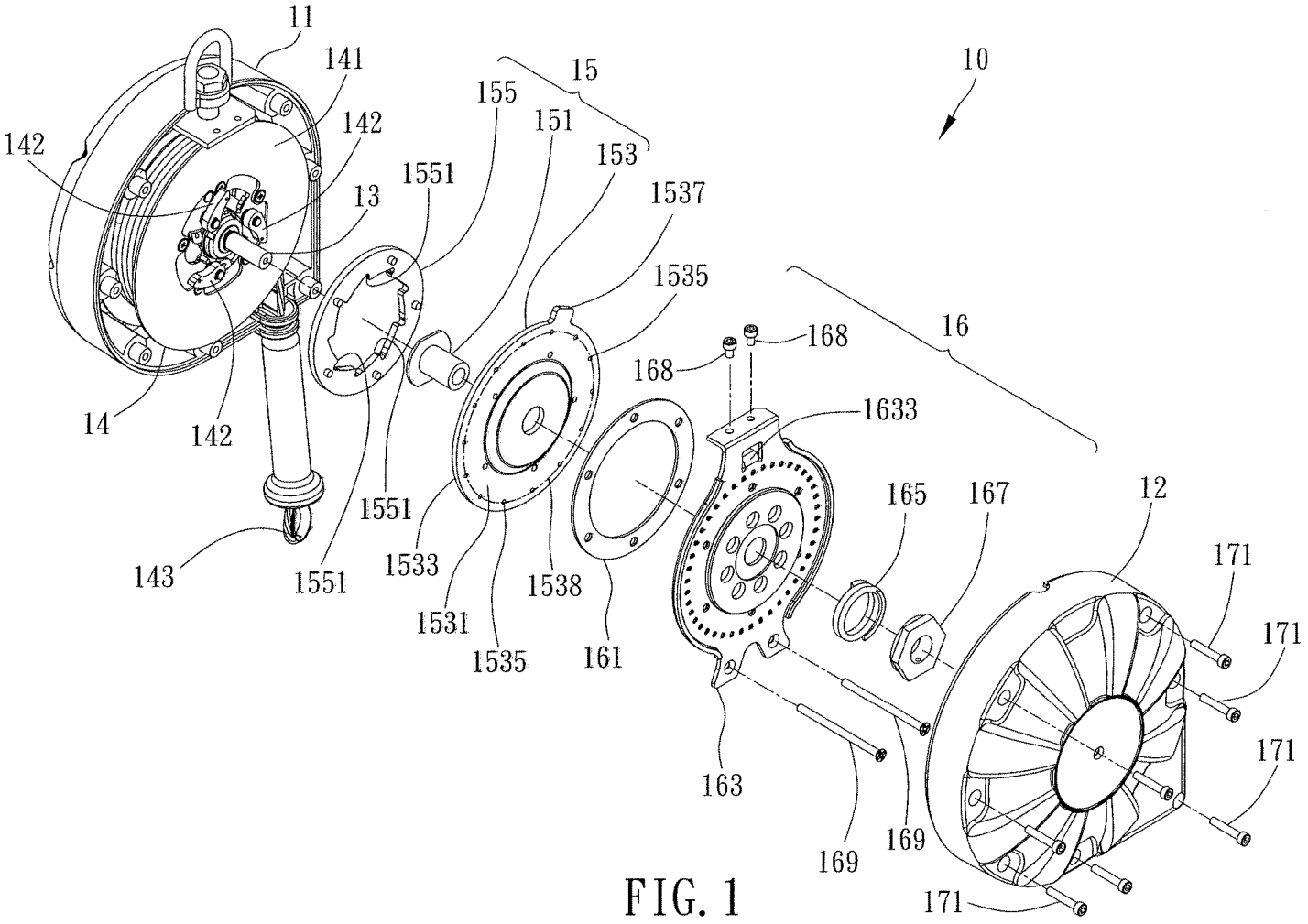
FIG. 1 is an exploded view of an auto-arresting safety device in accordance with the present invention.

Referring to FIG. 1, an auto-arresting safety device 10 in accordance with the present invention is shown. The auto-arresting safety device 10 comprises first and second shell members 11,12, an axle 13, a wire rope drum assembly 14, a fall arrest assembly 15 and a brake assembly 16.

The wire rope drum assembly 14 comprises a drum 141, a plurality of pawls 142 and a safety line 143. These pawls 142 are connected to the drum 141, and can swing relative to the drum 141. The safety line 143 has one end thereof connected to the axle 13, and an opposite end thereof extending out of the first and second shell members 11,12 and wound round the drum 141, and thus, the safety line 143 can be let off or rolled up by the drum 141.

The fall arrest assembly 15 comprises an axle sleeve 151, a connection plate 153 and a hollow tooth plate 155. The connection plate 153 comprises a top surface 1531, a bottom surface 1533, a plurality of raised portions 1535 and a protruded member 1537. The raised portions 1535 are located on the top surface 1531 of the connection plate 153 and equiangularly spaced from one another to create a path 1538. The path 1538 is formed by a virtual line (see the double dot dash line in the drawing) that connects the raised portion 1535. The protruded member 1537 extends outwardly from the peripheral edge of the connection plate 153. The hollow tooth plate 155 is an annular plate comprises a plurality of lugs 1551 equiangularly spaced along an inner perimeter thereof. In the present preferred embodiment, the connection plate 153 and the hollow tooth plate 155 are independent members assembled together, however, this arrangement is not a limitation. In an alternate form of the present invention, the connection plate 153 and the hollow tooth plate 155 can be integrally made in one piece to form a arrest body.

The brake assembly 16 comprises a brake pad 161, a holder 163, an adjustment spring 165, an adjustment screw bolt 167, two first screw bolts 168 and two second screw bolts 169. The holder 163 comprises a plurality of teeth 1631 (see FIG. 5) and a stop block 1633.

In the present preferred embodiment, the safety device 10 further comprises seven third screw bolts 171. The two first screw bolts 168 and the two second screw bolts 169 are adapted to fasten the holder 163 of the brake assembly 16 to the first shell member 11. The seven third screw bolts 171 are adapted to fasten the first shell member 11 and the second shell member 12 together. In actual application, using screw bolts to affix component parts of the safety device 10 is not a limited, and the number of the screw bolts used in the preferred embodiment of the present invention is also not a limitation. Further, because the holder 163 of the brake assembly 16 is connected to the first shell member 11, the second shell member 12 can be eliminated.

Figure 2:
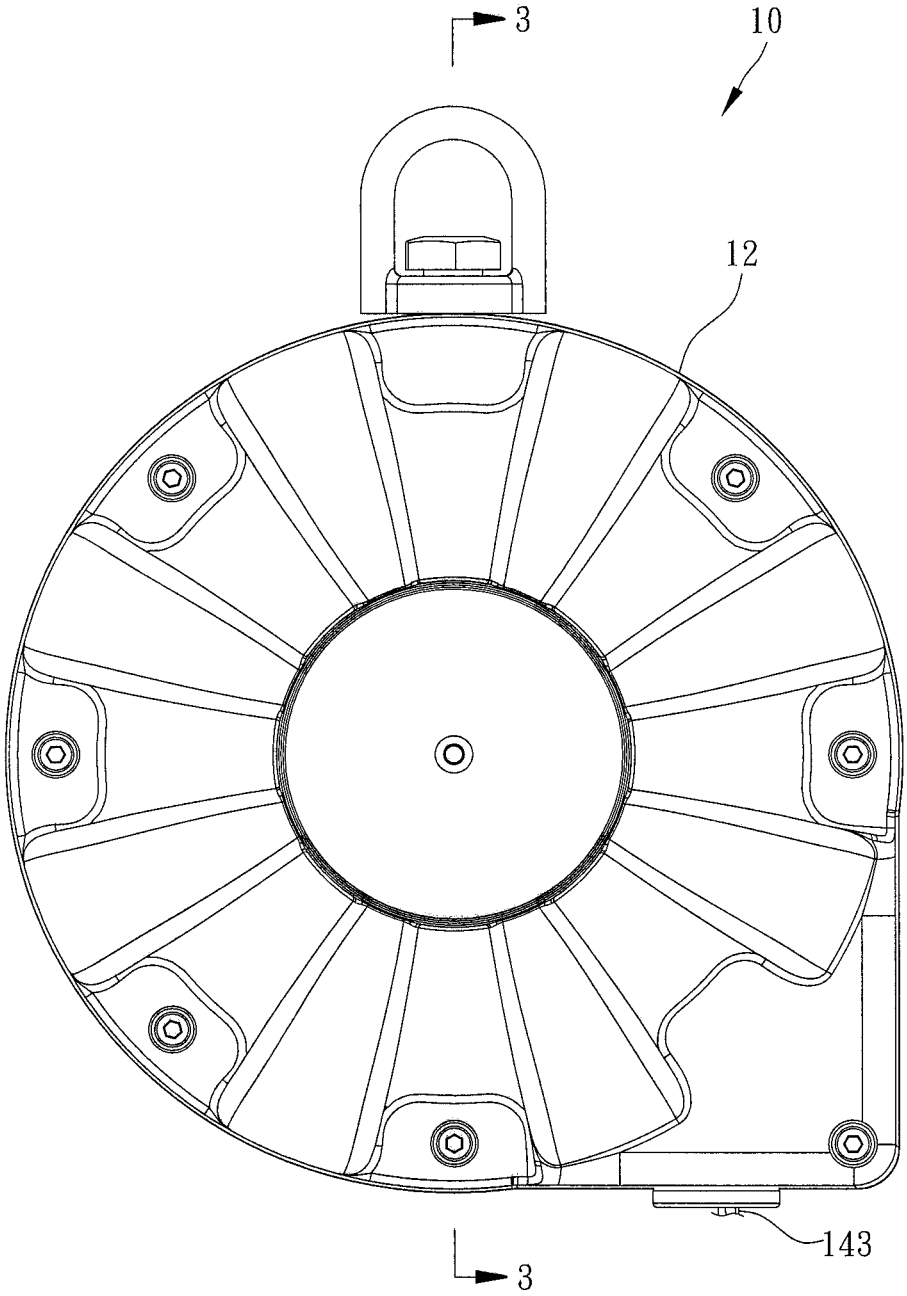
FIG. 2 is a front view of the auto-arresting safety device in accordance with the present invention.
Figure 3:
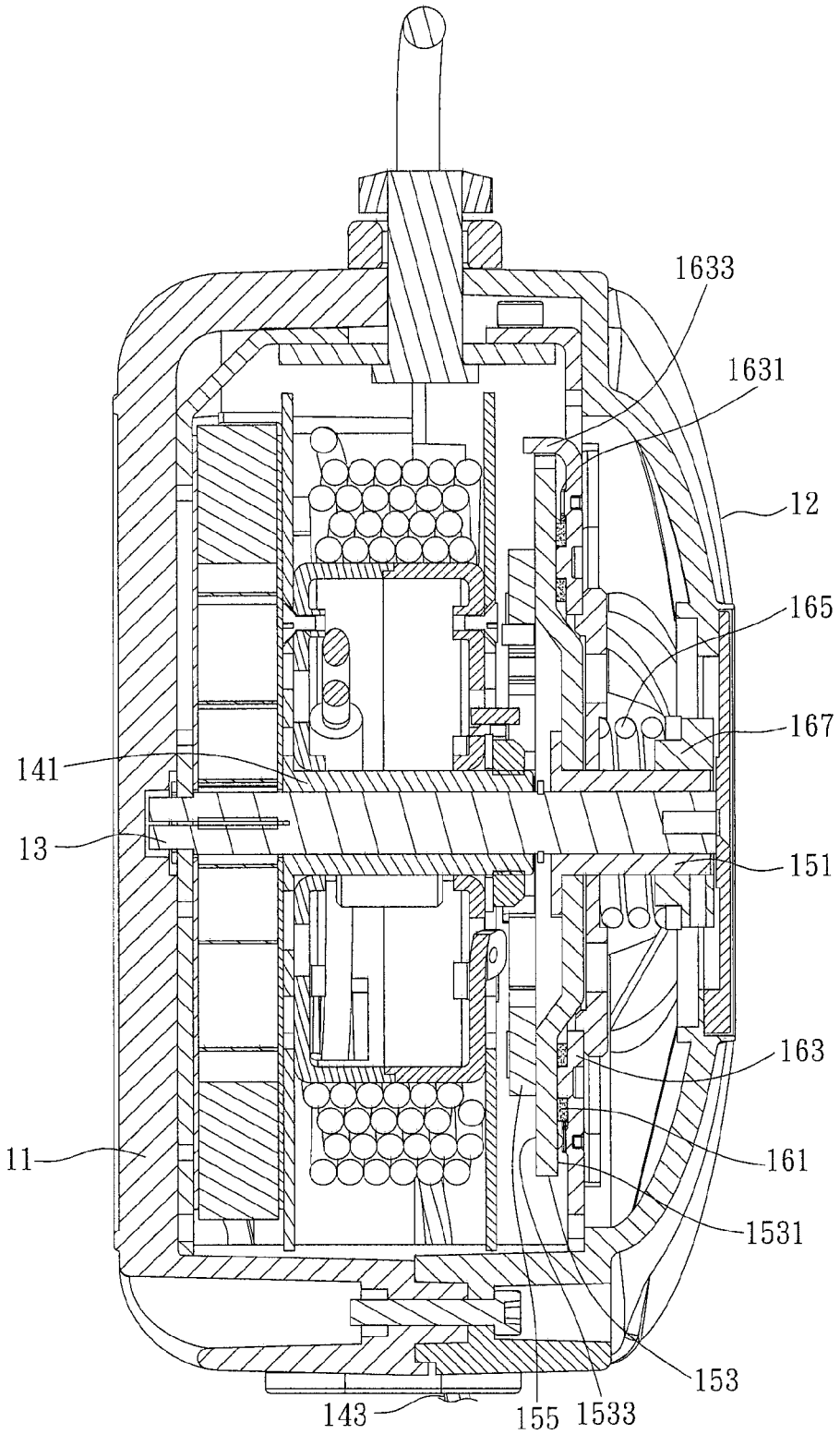
FIG. 3 is a sectional view taken along line 3-3 of FIG. 2.

As illustrated in FIGS. 2 and 3 where FIG. 2 is a front side view of the auto-arresting safety device 10 and FIG. 3 is a sectional view taken along line 3-3 of FIG. 2, the axle 13 is connected to the first shell member 11; the drum 141 is mounted on the axle 13 and rotatable relative to the axle 13. In addition to the drum 141, the pawls 142 and the safety line 143, the wire rope drum assembly 14 further comprises a variety of other spring members. These compositions are well known in the art and will not be repeated here.

The axle sleeve 151 is sleeved onto the axle 13, and rotatable relative to the axle 13. The connection plate 153 is connected to the axle sleeve 151. The hollow tooth plate 155 is mounted around the axle 13 and connected to the connection plate 153 and disposed at the bottom surface 1533 of the connection plate 153. The lugs 1551 of the hollow tooth plate 155 are disposed around the pawls 142 (see FIG. 6).

The brake pad 161 is mounted at the holder 163, and disposed between the holder 163 and the connection plate 153. The holder 163 is connected to the first shell member 11, comprising a plurality of teeth 1631 that face toward the top surface 1531 of the connection plate 153. The brake pad 161 is abutted against the top surface 1531 of the connection plate 153. The stop block 1633 extends downwardly from the holder 163 and disposed around the periphery of the connection plate 153. The adjustment spring 165 is sleeved onto the axle sleeve 151 and stopped at the holder 163. The adjustment screw bolt 167 is fastened to the axle sleeve 151, and rotatable to adjust the pressure that is imparted by the adjustment spring 165 to the holder 163.

The application of the adjustment screw bolt 167 and the adjustment spring 165 is explained hereinafter. If the load of the auto-arresting safety device 10 is set in the range of 60-120 kgs, and if the user's weight is 60 kgs, loosen the adjustment screw bolt 167 to reduce the pressure of the adjustment spring 165 against the holder 163 so as to comply with the safety requirement for protecting a user weighing 60 kgs. If the user's weight is 120 kgs, fasten tight the adjustment screw bolt 167 to increase the pressure of the adjustment spring 165 against the holder 163 so as to comply with the safety requirement for the protection of a user weighing 120 kgs. Thus, any user weighing within this range can operate the adjustment screw bolt 167 to adjust the pressure of the adjustment spring 165 against the holder 163 according to the selected load.

Figure 4:
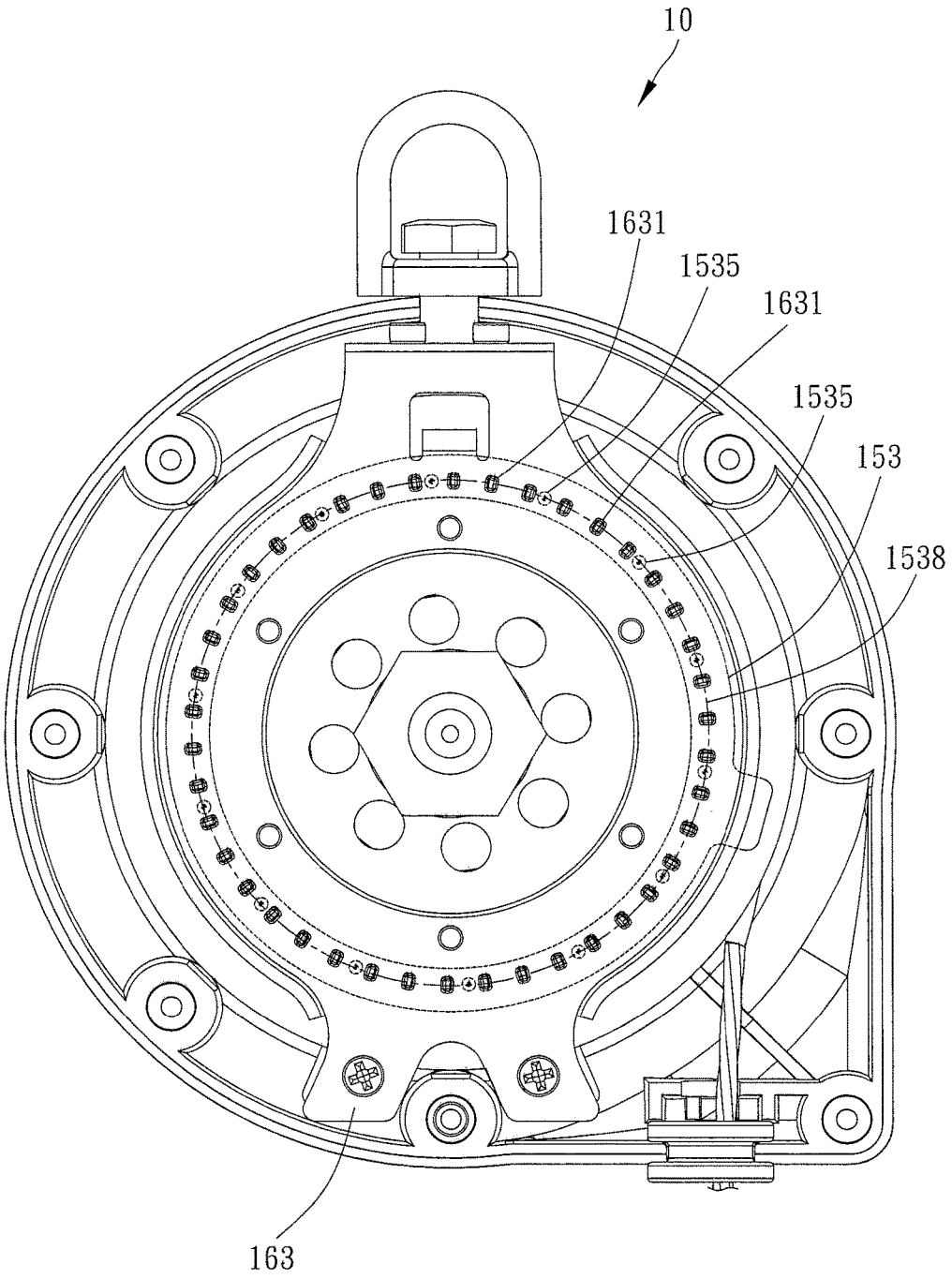
FIG. 4 is a schematic top view of FIG. 2 after removal of the second shell member.

FIG. 4 is a schematic top view of the safety device after removal of the second shell member 12 where the imaginary line indicates the contour of the connection plate 153; the double dot dash line indicates the path 1538 defined by the raised portions 1535.

Figure 5:
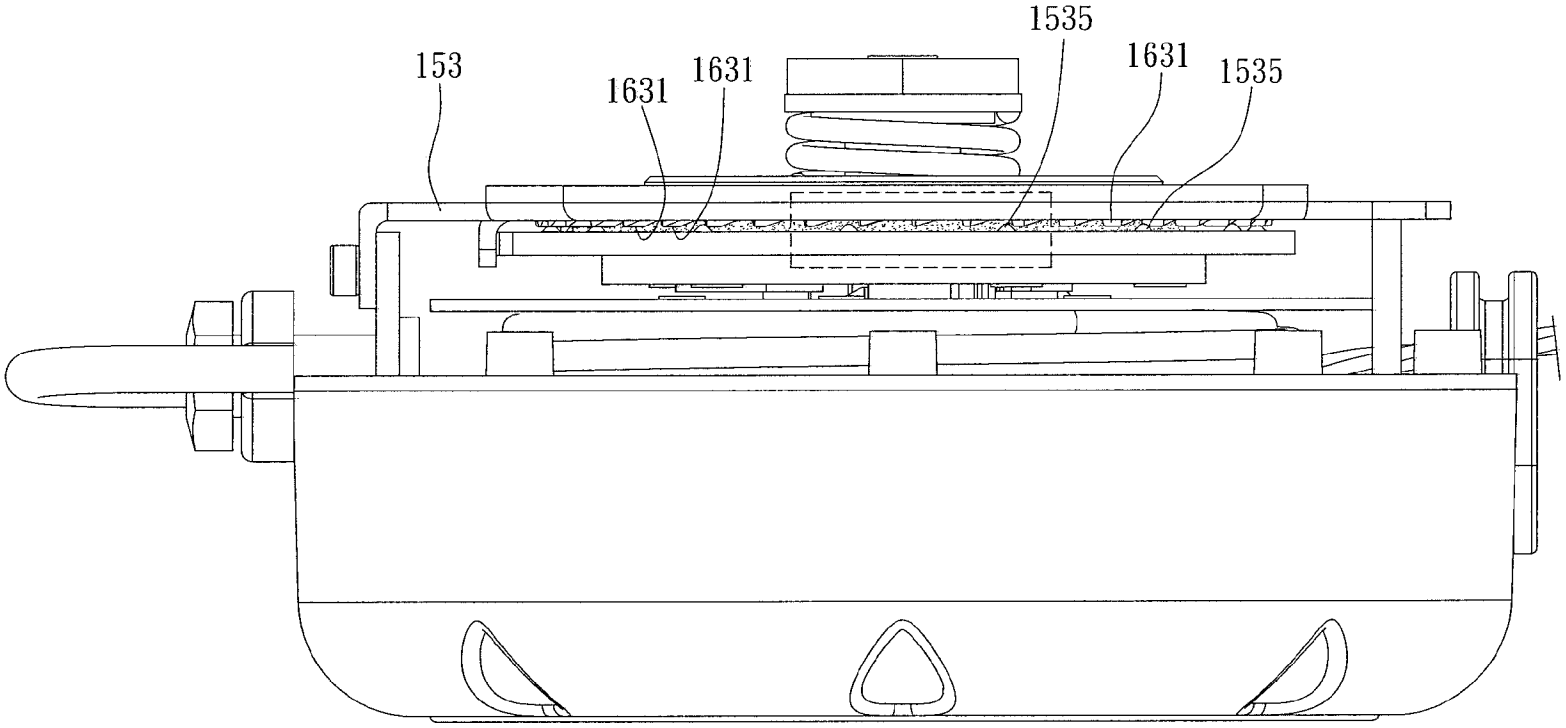
FIG. 5 is a left side view of FIG. 4.

FIG. 5 is a left side view of the safety device after removal of the second shell member 12, the teeth 1631 are disposed in the path 1538 that is defined by the raised portions 1535. Further, the raised portions 1535 can be conical protrusions, semicircular protrusions or protrusions of any other shape.

After understanding the composition of the auto-arresting safety device, its application and advantages are explained hereinafter.

Figure 6:
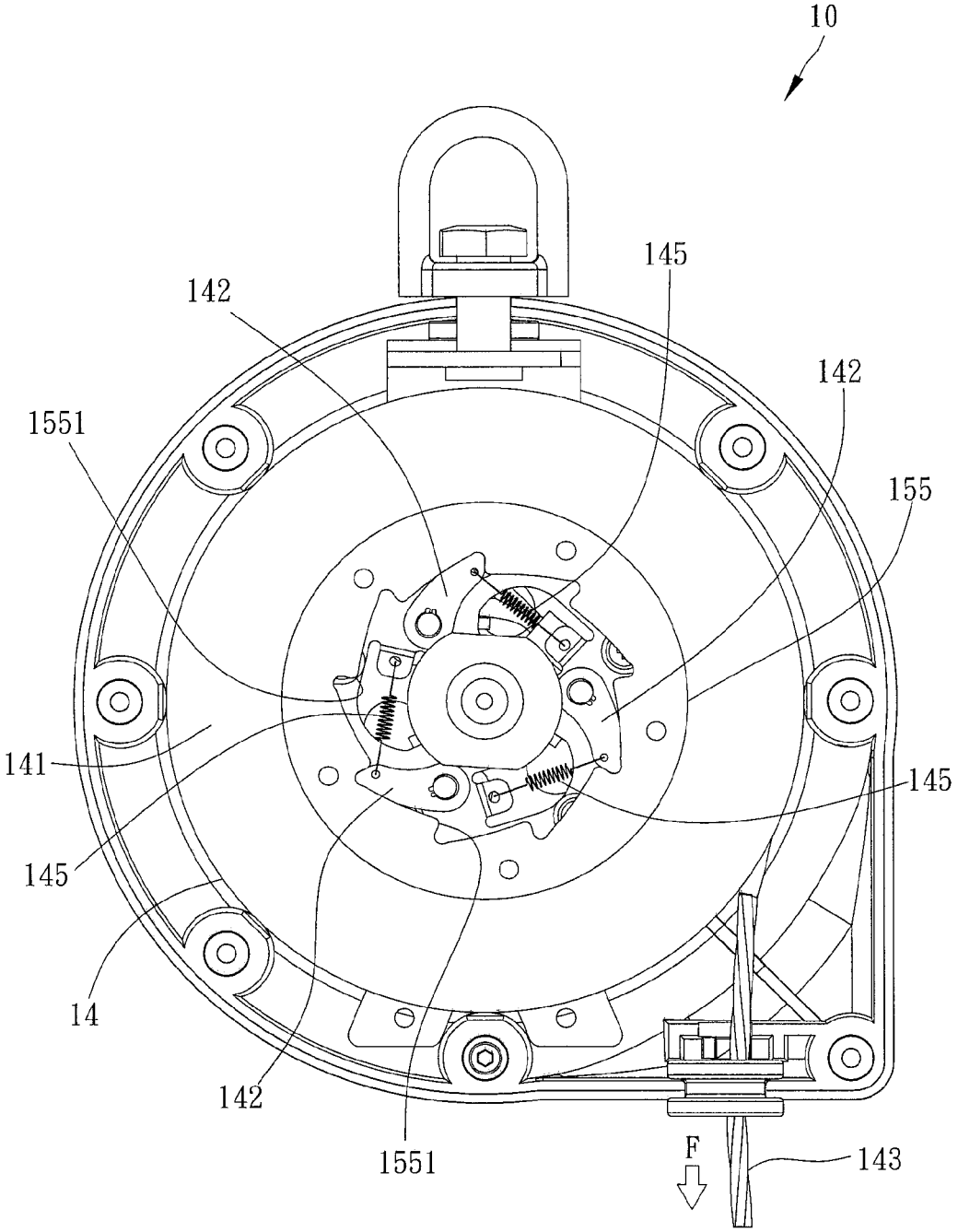
FIG. 6 is a schematic drawing of the auto-arresting safety device in accordance with the present invention, illustrating the relationship between the hollow tooth plate and the pawls.

As illustrated in FIG. 6, in normal use, the safety line 143 of the auto-arresting safety device 10 is pulled out when the user moves, and the pawls 142 are kept away from the lugs 1551 of the hollow tooth plate 155 due to the effect of the respective return springs 145 that are connected between the drum 141 and the pawls 142, i.e., the lugs 1551 of the hollow tooth plate 155 are not engaged with the pawls 142, and thus, the wire rope drum assembly 14 and the fall arrest assembly 15 are kept apart from each other and, the fall arrest assembly 15 is not rotated with the wire rope drum assembly 14.

If the safety line 143 receives an instantaneous fall load F over the threshold load, the pawls 142 will be forced by the centrifugal force of the rotating wire rope drum assembly 14 into engagement with the respective lugs 1551 of the hollow tooth plate 155, causing the drum 141 of the wire rope drum assembly 14 and the hollow tooth plate 155 of the fall arrest assembly 15 to be joined together. In other words, the wire rope drum assembly 14, the fall arrest assembly 15 and the brake assembly 16 are joined together, the fall arrest assembly 15 is rotated with the wire rope drum assembly 14 and, the brake pad 161 of the brake assembly 16 brakes the connection plate 153, stopping the wire rope drum assembly 14 from "further rotation". "Further rotation" means the rotating motion after engagement between the pawls 142 and the lugs 1551 of the hollow tooth plate 155 but not the rotating motion in the normal use.

Figure 7:
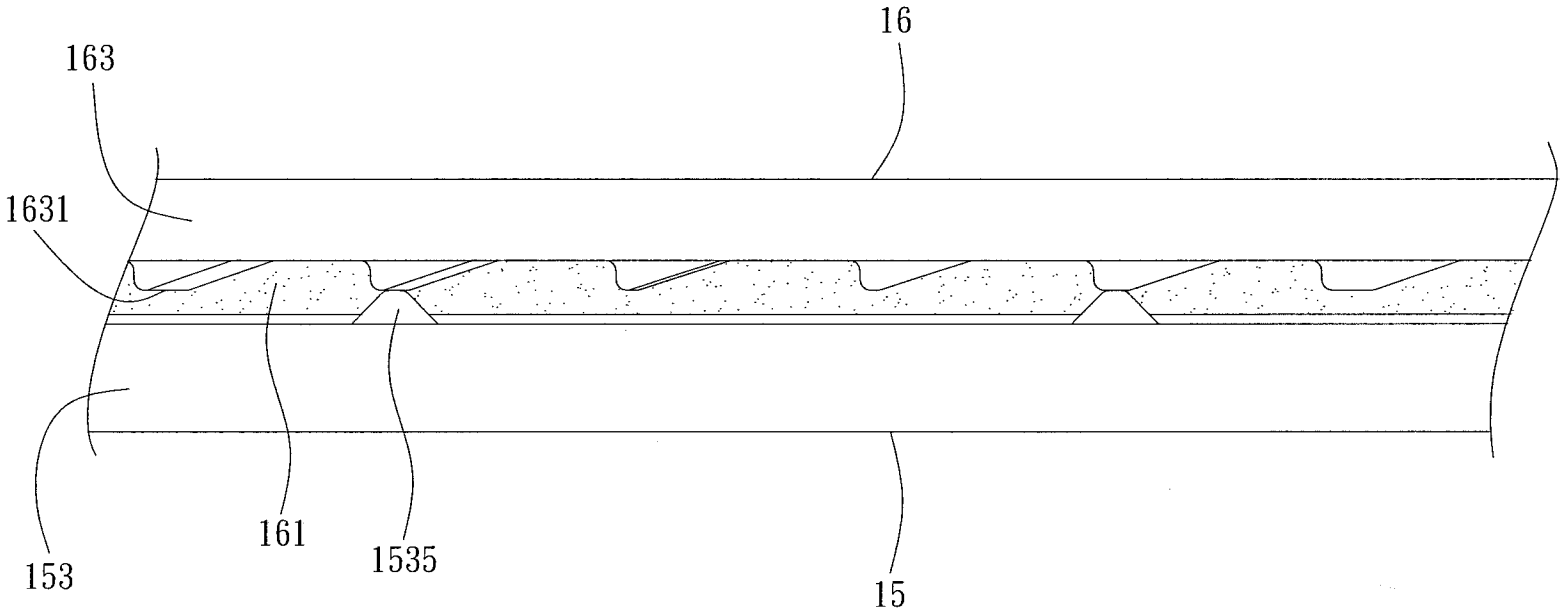
FIG. 7 is an enlarged view of the part surrounded by the imaginary line in FIG. 5, illustrating the raised portions of the connection plate at the peaks of the teeth of the holder.
Figure 8:
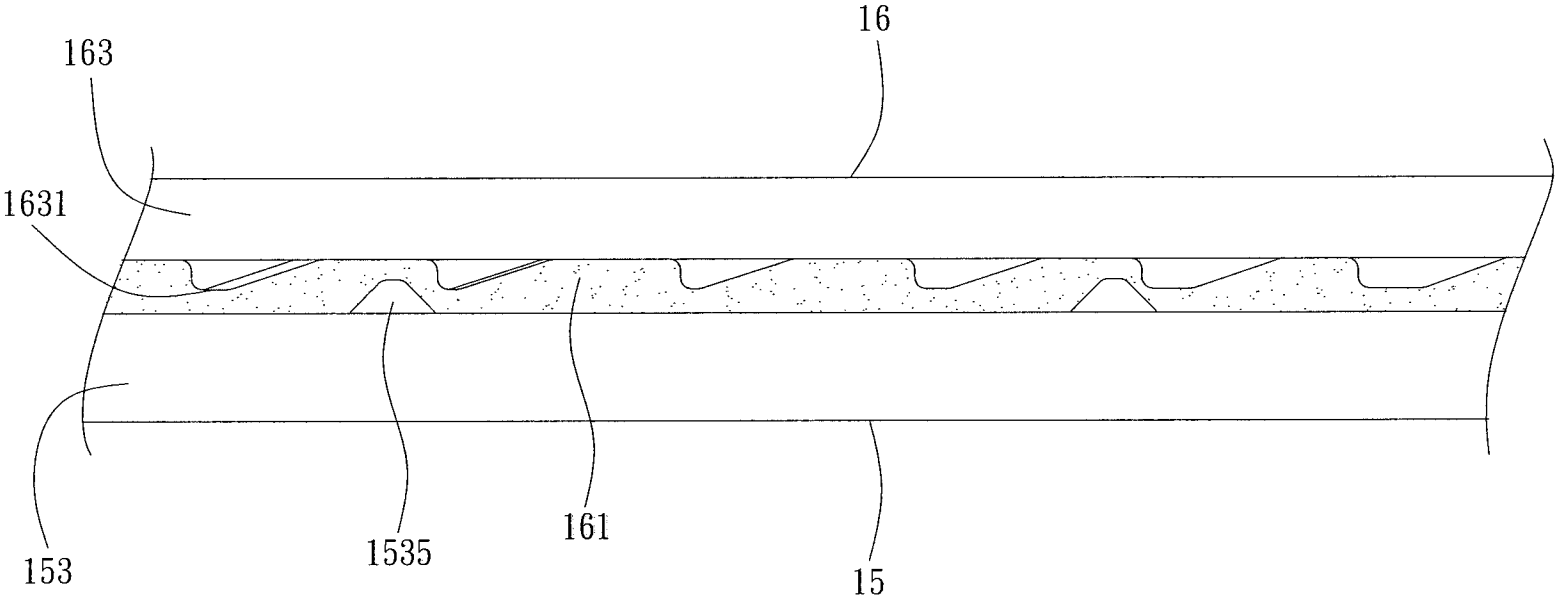
FIG. 8 corresponds to FIG. 7, illustrating the raised portions of the connection plate moved away from the peaks of the teeth of the holder.
Figure 9:
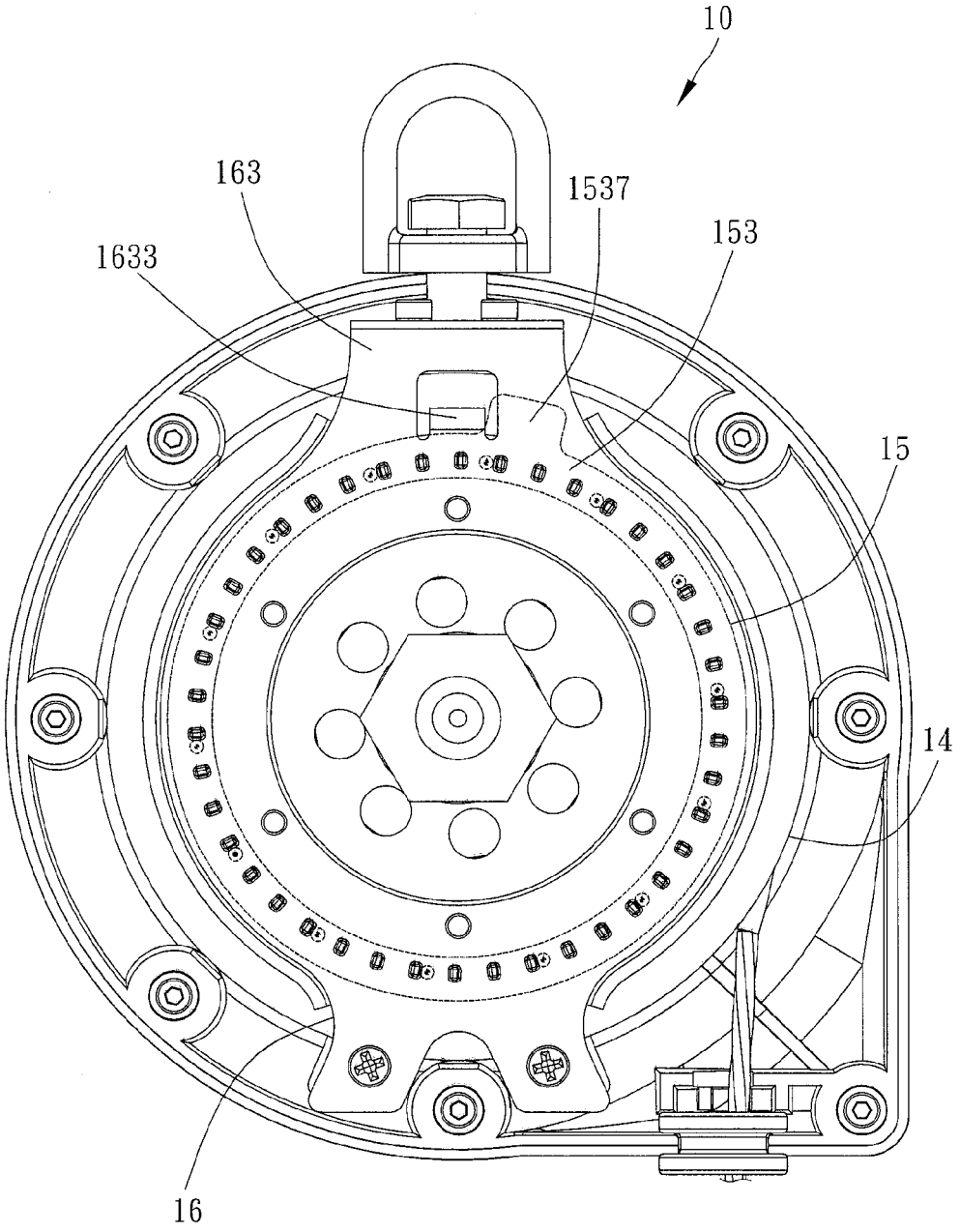
FIG. 9 is a schematic top view of FIG. 2 after removal of the second shell member, illustrating the stop block of the holder stopped against the protruded member of the connection plate.

In the further rotation, the raised portions 1535 of the connection plate 153 act on the teeth 1631 of the holder 163, as illustrated in FIG. 7 and FIG. 8. FIG. 7 illustrates the raised portions 1535 of the rotating connection plate 153 are abutted against the respective teeth 1631 of the holder 163. FIG. 8 illustrates the raised portions 1535 of the connection plate 153 moved away from the respective teeth 1631 of the holder 163.

As illustrated in FIG. 7, when the peaks of the raised portions 1535 of the rotating connection plate 153 touch the peaks of the respective teeth 1631 of the holder 163, the brake pad 161 and the connection plate 153 are kept apart from each other, allowing the wire rope drum assembly 14 and the fall arrest assembly 15 to be rotated relative to the brake assembly 16.

As illustrated in FIG. 8, the peaks of the raised portions 1535 of the rotating connection plate 153 are moved away from the peaks of the respective teeth 1631 of the holder 163, the brake pad 161 stops the connection plate 153 and the wire rope drum assembly 14 from rotating, i.e., the effect of braking occurs. Thus, the auto-arresting safety device intermittently brakes the wire rope drum assembly 14 from rotating to reduce and disperse the instantaneous maximum fall load, enabling the wire rope drum assembly 14 to let off the safety line 143 further.

Intermittently stopping the wire rope drum assembly 14 and the fall arrest assembly 15 from rotating relative to the brake assembly 16 means that the wire rope drum assembly 14 and the fall arrest assembly 15 are repeatedly and continuously actuated with a braking action and without a braking action until the brake assembly 16 has completely stopped the rotation of the wire rope drum assembly 14 and the fall arrest assembly 15 to achieve anti-fall safety protection.

In the present preferred embodiment, the brake pad 161 and the connection plate 153 are kept apart when the peaks of the raised portion 1535 of the connection plate 153 are abutted against the peaks of the respective teeth 1631 of the holder 163, however, in actual application, the brake pad 161 and the connection plate 153 can be kept apart as the raised portions 1535 reached other positions, thus, the separation state is not limited to the defined situation that the peaks of the raised portion 1535 of the connection plate 153 reach the peaks of the respective teeth 1631 of the holder 163.

In the explanation described above, during the stage of intermittently stopping the wire rope drum assembly 14 from rotating, the wire rope drum assembly 14 and the fall arrest assembly 15 can be further rotated relative to the brake assembly 16, however, in order for allowing the wire rope drum assembly 14 and the fall arrest assembly 15 to be rotated further in an acceptable range, the protruded member 1537 of the connection plate 153 will be stopped by the stop block 1633 of the holder 163 during the further rotation, and thus, the wire rope drum assembly 14 and the fall arrest assembly 15 are forcibly prevented from further rotation. In the present preferred embodiment, the acceptable range of the further rotation of the wire rope drum assembly 14 and the fall arrest assembly 15 is limited to one turn. In actual practice, the wire rope drum assembly 14 and the fall arrest assembly 15 can be braked in the intermittent rotation, thus, the protruded member 1537 of the connection plate 153 and the stop block 1633 of the holder 163 can be omitted.

In the present preferred embodiment, the housing of the auto-arresting safety device consists of two shell members (the first and second shell members), however, the configuration and structure of these two shell members are not intended to limit the scope of the present invention.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An auto-arresting safety device, comprising:

a shell member;

an axle connected to said shell member;

a wire rope drum assembly attached to and rotatable on said axle;

a fall arrest assembly coupled to and rotatable on said axle; and a brake assembly connected to said shell member and abutted against said fall arrest assembly;

wherein when said wire rope drum assembly receives a fall load over a threshold load, said wire rope drum assembly is engaged with said fall arrest assembly and, said brake assembly brakes the rotation of said wire rope drum assembly and said fall arrest assembly intermittently until said wire rope drum assembly stops rotating, wherein said wire rope drum assembly comprises a drum rotatably supported on said axle and a plurality of pawls connected and swingable relative to said drum; said fall arrest assembly comprises an axle sleeve and an arrest body, said axle sleeve sleeved onto said axle and rotatable relative to said axle, said arrest body connected to said axle sleeve, said arrest body comprising a plurality of lugs and a plurality of raised portions, said lugs equiangularly spaced around said pawls, said raised portions equiangularly spaced from one another to create a path; said brake assembly comprises a plurality of teeth equiangularly spaced from one another and disposed in said path.

2. The auto-arresting safety device as claimed in claim 1, wherein said arrest body comprises a connection plate and an hollow tooth plate, said connection plate being connected to said axle sleeve and has a top surface that carries said raised portions and an opposing bottom surface, said hollow tooth plate being connected to said bottom surface of said connection plate around said axle; said lugs are formed on said hollow tooth plate; said brake assembly comprises a brake pad and a holder, said brake pad being connected to said holder and disposed between said holder and said connection plate, said holder being connected to said shell member; said teeth are formed on said holder.

3. The auto-arresting safety device as claimed in claim 2, wherein said connection plate comprises a protruded member; said holder comprises a stop block for stopping against said protruded member of said connection plate.

4. The auto-arresting safety device as claimed in claim 2, wherein said brake assembly comprises an adjustment spring sleeved onto said axle sleeve and stopped against said holder, and an adjustment screw bolt axially threaded into said axle sleeve and rotatable to adjust the pressure of said adjustment spring against said holder.

* * * * *